US008777357B2

(12) United States Patent
Clippingdale

(10) Patent No.: US 8,777,357 B2
(45) Date of Patent: Jul. 15, 2014

(54) IMAGE AND PRINTHEAD CONTROL

(75) Inventor: Andrew John Clippingdale, Cambridge (GB)

(73) Assignee: Tonejet Limited, Royston, Hertfordshire (GB)

( * ) Notice: Subject to any disclaimer, the term of this patent is extended or adjusted under 35 U.S.C. 154(b) by 35 days.

(21) Appl. No.: 13/701,531

(22) PCT Filed: Jun. 6, 2011

(86) PCT No.: PCT/EP2011/059244

§ 371 (c)(1),
(2), (4) Date: Dec. 3, 2012

(87) PCT Pub. No.: WO2011/154334

PCT Pub. Date: Dec. 15, 2011

(65) Prior Publication Data

US 2013/0076824 A1 Mar. 28, 2013

(30) Foreign Application Priority Data

Jun. 11, 2010 (EP) ..... 10165661

(51) Int. Cl.
*B41J 29/38* (2006.01)

(52) U.S. Cl.
USPC ..... 347/14

(58) Field of Classification Search
CPC ..... B41J 2/07; B41J 2/06; B41J 2/04525; B41J 2/04586; B41J 2/04526; B41J 2/04576; G06K 15/105
USPC ..... 347/14
See application file for complete search history.

(56) References Cited

U.S. PATENT DOCUMENTS 7,708,385 B1 5/2010 Kim et al.

FOREIGN PATENT DOCUMENTS

| | | | |
|---|---|---|---|
| WO | 9311866 | A1 | 6/1993 |
| WO | 9727056 | A1 | 7/1997 |
| WO | 9727058 | A1 | 7/1997 |
| WO | 9832609 | A1 | 7/1998 |
| WO | 9842515 | A1 | 10/1998 |
| WO | 0130576 | A1 | 5/2001 |
| WO | 03061975 | A1 | 7/2003 |
| WO | 03101741 | A2 | 12/2003 |

*Primary Examiner* — Julian Huffman
(74) *Attorney, Agent, or Firm* — Roylance, Abrams, Berdo & Goodman, LLP

(57) ABSTRACT

A method of preparing a two-dimensional bit-mapped image is disclosed in which the image has n pixels per row for printing using one or more printheads each having a row of ejection locations. Each ejection location has associated ejection electrodes to which a voltage is applied sufficient to cause particulate agglomerations to be formed from within a body of printing fluid. In order to cause charged particulate agglomerations to be ejected as printed droplets from selected ejection locations, voltage pulses of predetermined amplitude and duration, as determined by the respective bit values of the individual pixels of rows of the image, are applied to the electrodes of the selected ejection locations.

4 Claims, 16 Drawing Sheets

Examples of compensation at a solid edge, restoring edge position by application of subsidiary algorithm followed by three examples of compensation Target image:

k=6:

k=5:

k=4:

k=3:

k=2:

k=1:

IMAGE AND PRINTHEAD CONTROL

The present invention relates to electrostatic inkjet print technologies and, more particularly, to printheads and printers of the type such as described in WO 93/11866 and related patent specifications.

Electrostatic printers of this type eject charged solid particles dispersed in a chemically inert, insulating carrier fluid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates an electrophoretic force that is large enough to overcome the surface tension. The electric field is generated by creating a potential difference between the ejection location and the substrate; this is achieved by applying voltages to electrodes at and/or surrounding the ejection location.

The location from which ejection occurs is determined by the printhead geometry and the location and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particle so that the direction of the electrophoretic force is towards the substrate. Further, the overall geometry of the printhead structure and the position of the electrodes are designed such that concentration and then ejection occurs at a highly localised region around the tip of the protrusions.

To operate reliably, the ink must flow past the ejection location continuously in order to replenish the particles that have been ejected. To enable this flow the ink must be of a low viscosity, typically a few centipoises. The material that is ejected is highly viscous because of the high concentration of particles; as a result, the technology can be used to print onto non-absorbing substrates because the material will not spread upon impact.

Various printhead designs have been described in the prior art, such as those in WO 93/11866, WO 97/27058, WO 97/27056, WO 98/32609, WO 98/42515, WO 01/30576 and WO 03/101741.

WO 98/42515, proposes a system for controlling the application of first voltage pulses to a respective ejection electrode associated with an ejection location and second voltage pulses to a respective secondary electrode associated with the ejection location, such that, when a voltage pulse is applied to the ejection electrode, a voltage pulse, inverted with respect to the pulse applied to the ejection electrode, is applied to the secondary electrode. This technique is used to overcome problems with capacitive coupling between proximate ejection locations which otherwise can adversely effect ejection. As cross-talk can be reduced if lower voltages are used, and it is therefore desirable to use the smallest possible voltages to cause ejection and inverting the voltage applied to the secondary electrode maintains the differential at a desirable level. The provision of voltages on secondary electrodes of this type also serves to preserve a symmetrical electrical field shape which avoids or reduces the deflection (side-to-side) resulting otherwise from asymmetrical fields resulting from cross-talk arising from the voltages applied to adjacent ejection locations.

FIG. 1 is a drawing of the tip region of an electrostatic printhead 1 of the type described in this prior art, showing several ejection upstands 2 each with a tip 21. Between each two ejection upstands is a wall 3, also called a cheek, which defines the boundary of each ejection cell 5 or ejector. In each cell, ink flows in the two channels 4, one on each side of the ejection upstand 2 and in use the ink meniscus is pinned between the top of the cheeks and the top of the ejection upstand. In this geometry the positive direction of the z-axis is defined as pointing from the substrate towards the printhead, the x-axis points along the line of the tips of the ejection upstands and the y-axis is perpendicular to these.

FIG. 2 is a schematic diagram in the x-z plane of a single ejection cell 5 in the same printhead 1, looking along the y-axis taking a slice through the middle of the tips of the upstands 2. This figure shows the cheeks 3, the ejection upstand 2, the ejection location 6, the location of the ejection electrodes 7 and the position of the ink meniscus 8. The solid arrow 9 shows the ejection direction and also points towards the substrate. Typically, the pitch between the ejection cells is 168 μm. In the example shown in FIG. 2 the ink usually flows into the page, away from the reader.

FIG. 3 is a schematic diagram of the same printhead 1 in the y-z plane showing a side-on view of an ejection upstand along the x-axis. This figure shows the ejection upstand 2, the location of the electrode 7 on the upstand and a component known as an intermediate electrode (10). The intermediate electrode 10 is a structure that has electrodes 101, on its inner face (and sometimes over its entire surface), that in use are biased to a different potential from that of the ejection electrodes 7 on the ejection upstands 2. The intermediate electrode 10 may be patterned so that each ejection upstand 2 has an electrode facing it that can be individually addressed, or it can be uniformly metallised such that the whole surface of the intermediate electrode 10 is held at a constant bias. The intermediate electrode 10 acts as an electrostatic shield by screening the ejection location/ejector from external electric fields and allows the electric field at the ejection location 6 to be carefully controlled.

The solid arrow 11 shows the ejection direction and again points in the direction of the substrate. In FIG. 3 the ink usually flows from left to right.

In operation, it is usual to hold the substrate at ground (0 V), and apply a voltage. $V_{IE}$, between the intermediate electrode 10 and the substrate. A further potential difference of $V_B$ is applied between the intermediate electrode 10 and the electrodes 7 on the ejection upstand 2 and the cheeks 3, such that the potential of these electrodes is $V_{IE}+V_B$. The magnitude of $V_B$ is chosen such that an electric field is generated at the ejection location 6 that concentrates the particles, but does not eject the particles. Ejection spontaneously occurs at applied biases of $V_B$ above a certain threshold voltage. $V_S$, corresponding to the electric field strength at which the electrophoretic force on the particles exactly balances the surface tension of the ink. It is therefore always the case that $V_B$ is selected to be less than $V_S$. Upon application of $V_B$, the ink meniscus moves forwards to cover more of the ejection upstand 2. To eject the concentrated particles, a further voltage pulse of amplitude $V_P$ is applied to the ejection upstand 2, such that the potential difference between the ejection upstand 2 and the intermediate electrode 10 is $V_B+V_P$. Ejection will continue for the duration of the voltage pulse. Typical values for these biases are $V_{IE}$=500 volts, $V_B$=1000 V and $V_P$=300 volts.

The voltages actually applied in use may be derived from the bit values of the individual pixels of a bit-mapped image to be printed. The bit-mapped image is created or processed using conventional design graphics software such as Adobe Photoshop and saved to memory from where the data can be output by a number of methods (parallel port, USB port, purpose-made data transfer hardware) to the print head drive electronics, where the voltage pulses which are applied to the ejection electrodes of the printhead are generated.

One of the advantages of electrostatic printers of this type is that greyscale printing can be achieved by modulating either the duration or the amplitude of the voltage pulse. The voltage pulses may be generated such that the amplitude of individual pulses are derived from the bitmap data, or such that the pulse duration is derived from the bitmap data, or using a combination of both techniques.

Electrostatic printers of the type described here eject viscous jets of particulate material from a non-viscous carrier fluid. This offers many advantages over conventional digital printers based on piezoelectric or thermal technology including:

- Substrate independence: ability to print onto absorbing and non-absorbing substrates without material spreading on impact
- Smaller dot diameters
- Improved dot formation leading to a reduced number of satellite droplets.
- Greyscale printing
- Compatibility with a wide range of materials
- Increased reliability:
  - No moving parts
  - Very open structure (no small nozzles) results in fewer blockages
  - Recirculating ink keeps ink channels/ejectors clear and keeps particles suspended
- Low cost: simple printhead structure can be made from simple manufacturing techniques Printheads comprising any number of ejectors can be constructed by fabricating numerous cells 5 of the type shown in FIGS. 1 to 3 side-by-side along the x-axis. A controlling computer converts image data (bit-mapped pixel values) stored in its memory into voltage waveforms (commonly digital square pulses) that are supplied to each ejector individually. By moving the printhead 1 relative to the substrate in a controllable manner, large area images can be printed onto the substrate.

Problems can arise when two neighbouring cells 5 are printing and a third adjacent cell is not printing. This generates an asymmetric electric field at the ejection location of the central ejector that will deflect the ejected material from an ideal trajectory that is straight towards the substrate. This effect is called electrostatic crosstalk (or crosstalk for short).

This physical reason for crosstalk is illustrated in FIG. 4. This shows calculated equipotentials generated by three adjacent cells 5 whereby the electrodes 7 in the right hand cell are at a potential of $V_B$=925 V and the electrodes of the other two cells are at $V_B+V_P$=925+400 V=1,325 V. This is purely an electrostatic calculation relating to the fixed structure of the printhead and the effects of ink are neglected. The boundary condition of the top edge of the model is V=0, which is a reasonable approximation of the conducting inner face of the intermediate electrode 10 and is consistent with the values of $V_B$ and $V_P$ used. The boundary condition of the side and bottom edges of the region is set such that they act as mirror planes for the equipotentials. This is reasonable as this models a repeat set of ejectors along the x-axis; the effect of the mirror plane at the bottom of the region is considered to have little influence over the electric field around the ejection region.

FIG. 4 shows that the equipotentials are bent around the tip 21 of the central ejection upstand 2 and therefore that the electric field (which is perpendicular to the equipotentials) has a non-zero component parallel to the x-axis. According to this model, the ratio of the component of the electric field parallel to the z-axis ($E_Z$) to the component of the electric field parallel to the x-axis ($E_X$) is approximately 60. The calculated trajectory of a test particle in this electric field confirms that the particle is deflected from the ideal trajectory parallel to the z-axis in a direction parallel to the x-axis as a result of this non-zero $E_X$.

A cell's immediate neighbours have the most influence on the direction of the ink ejected, with second and third neighbours creating a similar, but decreasing effect.

According to the present invention there is provided a method of preparing a two-dimensional bit-mapped image having n pixels per row for printing using one or more printheads each having a row of ejection locations, each ejection location having associated ejection electrodes to which a voltage is applied in use sufficient to cause particulate agglomerations to be formed from within a body of printing fluid, and wherein, in order to cause charged particulate agglomerations to be ejected as printed droplets from selected ejection locations, voltage pulses of predetermined amplitude and duration, as determined by the respective bit values $P_i$, where $1 \le i \le n$, of the individual pixels of rows of the image, are applied to the electrodes of the selected ejection locations, wherein $P_i$ is determined by the expression:

FOR i=1 to n:
  FOR j=1 to (4k+1):
    IF $P_i \le P_L$ AND $P_{i+1} \ldots P_{i+(1+k)} \ge P_H$ then $P_{i+j} := \alpha_j \cdot P_{i+j}$
or
  IF $P_i \le P_L$ AND $P_{i-1} \ldots P_{1-(1+k)} \ge P_H$ then $P_{i-j} := \alpha_j \cdot P_{i-j}$
  where $\alpha_j < 1$ for j=1 or j=2k and $\alpha_j \le 1$ for j=3k or j=4k
OR
FOR i=1 to n:
  FOR j=1 to (4k+1):
    IF $P_i \le P_L$ AND $P_{i+1} \ldots P_{i+(1+k)} \ge P_H$ then $P_{i+j} := \alpha_j \cdot P_{i+j}$
or
  IF $P_i \le P_L$ AND $P_{i-1} \ldots P_{i-(1+k)} \ge P_H$ then $P_{i-j} := \alpha_j \cdot P_{i-j}$
  where $\alpha_j > 1$ for $k \ge 2$ and (j=k or k+1), and $\alpha_j \ge 1$ for $k \ge 3$ and
  ($2 \le j \le k-1$ or $k+2 \le j \le 2k-1$ or j=2k+1, 3k+1, or 4k+1), where $P_L$ is a low threshold and $P_H$ is a high threshold defined as $0 < P_L < P_H < 1$, and where the arrangement of the printheads forms an array of ejector locations on a spacing parallel to the rows of the image of k times the pixel spacing of the image arranged parallel to the width of the image, with A interleaved printheads arranged to print on B interleaved passes, such that k=A·B such that a given printhead on a given pass will print the pixels of every kth column of the image.

The equations above show how, for each iteration of the logic loop, the value of $P_{i+j}$ used for printing becomes $\alpha_j \cdot P_{i+j}$ of the original image. Note that the use of the logic operator ":=" has its usual meaning of 'is defined to be' or 'becomes'. Another way of writing this would be to write $[P_{i+j}]_{PRINT} = \alpha_j \cdot [P_{i+j}]_{IMAGE}$.

The above method may additionally be augmented wherein the values of $P_{i+1}$ or $P_{i-1}$ are additionally adjusted in a preliminary step in accordance with the following algorithm (algorithm 2):

FOR $i = 1$ to $n$:

$$\text{IF} \left\{ \begin{array}{ll} P_i \le P_L & 1 \le k \le 3 \\ P_i \ \ldots \ P_{i-(k-3)} \le P_L & k \ge 4 \end{array} \right\}$$

AND $P_{i+1} \ \ldots \ P_{i+(1+k)} \ge P_H$ then $P_{i+1} := P_i$

OR $$\text{IF} \left\{ \begin{array}{ll} P_i \le P_L & 1 \le k \le 3 \\ P_i \ \ldots \ P_{i+(k-3)} \le P_L & k \ge 4 \end{array} \right\}$$

AND $P_{i+1} \ \ldots \ P_{i-(1+k)} \ge P_H$ then $P_{i-1} := P_i$

This additional compensation is useful where there are no printed areas immediately adjacent the area of print under consideration and acts to remove the first pixel of a group being printed. For example, when there are smaller areas of 'negative' printing (i.e. unprinted areas within a larger background of printed pixels), this helps to achieve more 'open' or better defined characters. The technique is also useful if there is a tendency for ink to 'spread' on the substrate before drying.

The bit values may be adjusted such that the voltage and/or duration of the ejection pulse applied to the electrodes of at least one of two adjacent ejection locations (or 'ejectors')

which are printing is reduced or increased to change the deflection of each of the droplets ejected from said adjacent ejection locations.

When the bit-mapped image is such that two adjacent ejection locations/ejectors are arranged to cause ejection simultaneously, the bit values can be adjusted such that the voltage and/or duration of the ejection pulse applied to the electrodes of said two adjacent ejection locations is reduced to adjust the deflection of each of the ejected droplets from the adjacent ejection locations.

The invention includes a method of printing a bit-mapped image using a printhead having a row of ejection locations, each ejection location having associated ejection electrodes to which a voltage is applied in use sufficient to cause particulate agglomerations to be formed from within a body of printing fluid, and wherein, in order to cause charged particulate agglomerations to be ejected as printed droplets from selected ejection locations, voltage pulses of predetermined amplitude and duration, as determined by the bit values of the individual pixels of the image, are applied to the electrodes of the selected ejection locations, wherein the bit-mapped image has printed pixels such as to require simultaneous ejection from two adjacent ejection locations of a printhead, on one side of which ejection locations there is no simultaneously printing ejection location, the method including preparing the bit-mapped image according to claim 1.

The printhead(s) may be arranged to print more than two adjacent pixels from the same ejection location on sequential multiple passes.

Similar issues arise and the same solution can be used when the printhead(s) carry out printing in a single pass, printing all required pixels of each row either at the same time (if the printhead resolution is high) or else printing the required pixels from multiple (interleaved) printheads closely spaced one behind another.

The printhead may be indexed multiple times.

The reason why there can be no simultaneously selected ejection locations at which ejection occurs is because either the pattern being printed has 'white space', ie unprinted areas, or else because the adjacent ejection locations are at the end of the row of ejection locations and thus there are no further ejection locations from which droplets could be ejected.

Examples of methods and apparatus according to the present invention will now be described with reference to the accompanying drawings, in which.

Figure 10A:
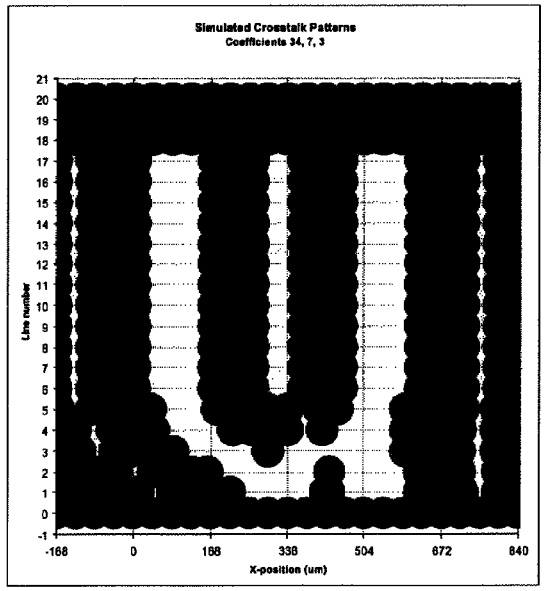
Figure 10B:
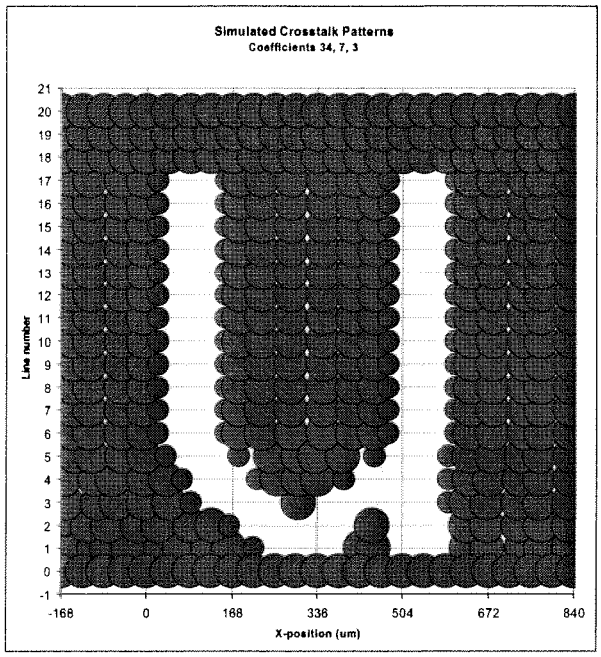
Figure 11:
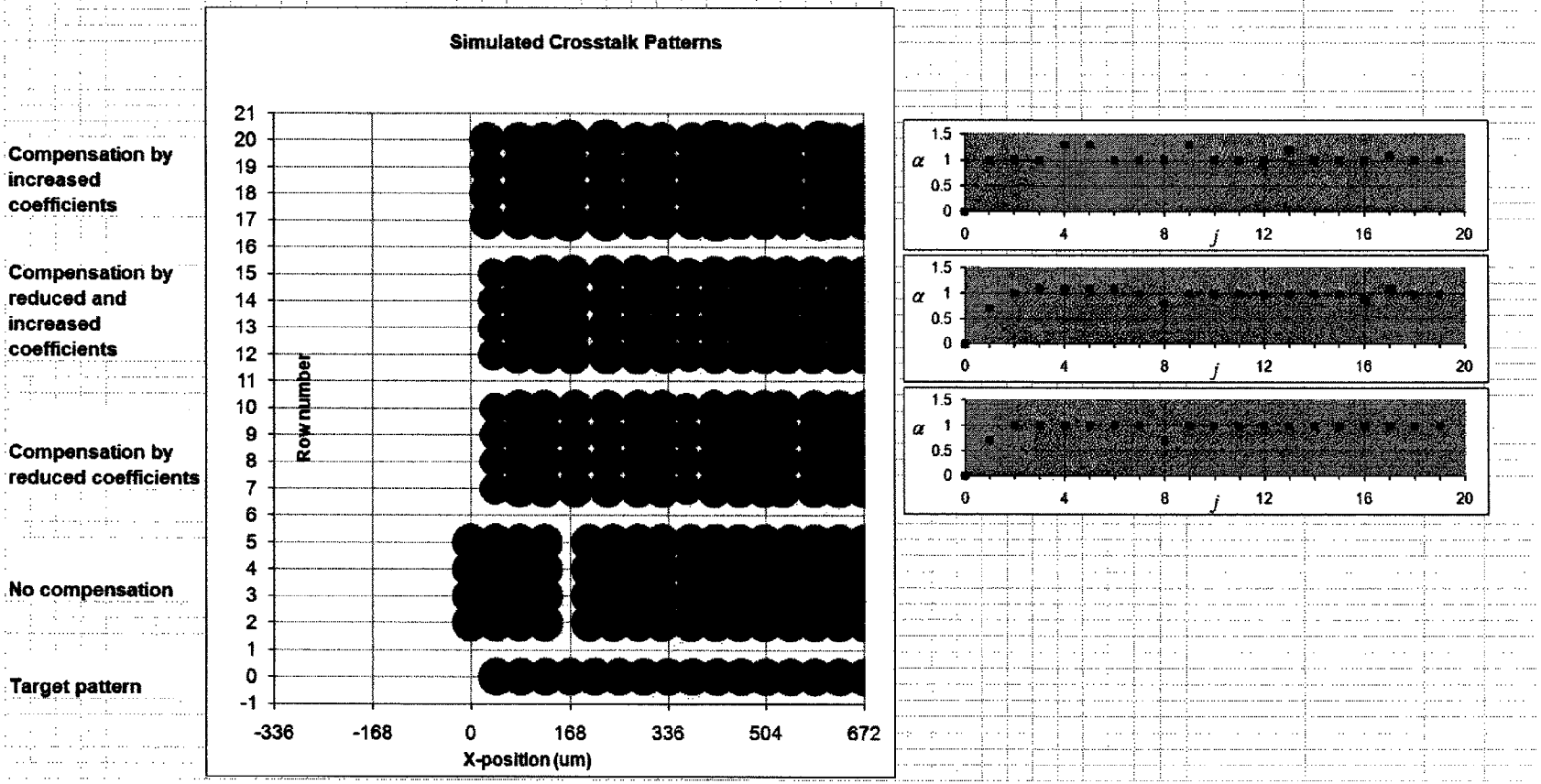
Figure 12:
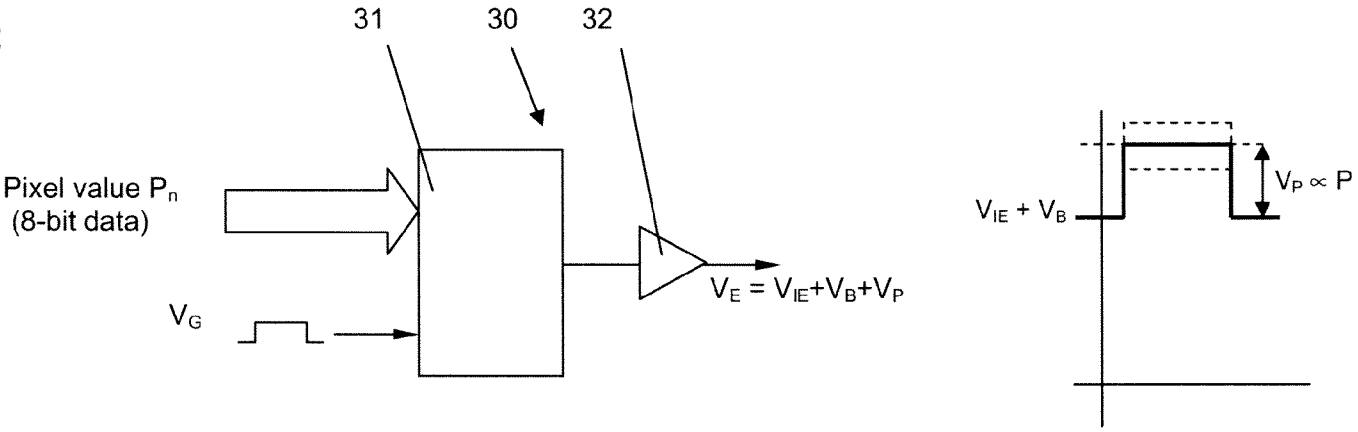
Figure 13:
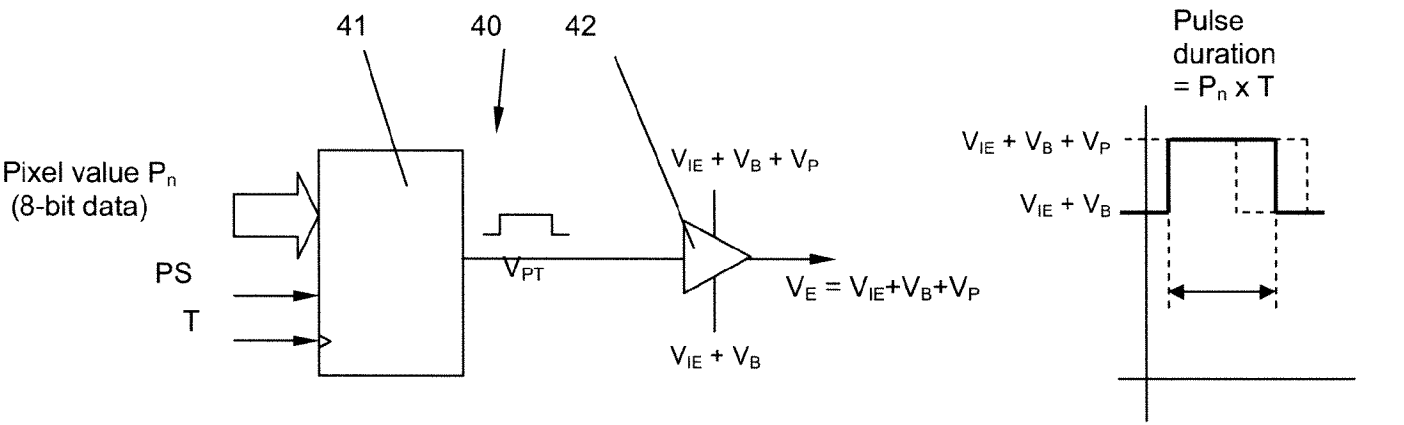
Figure 14A:
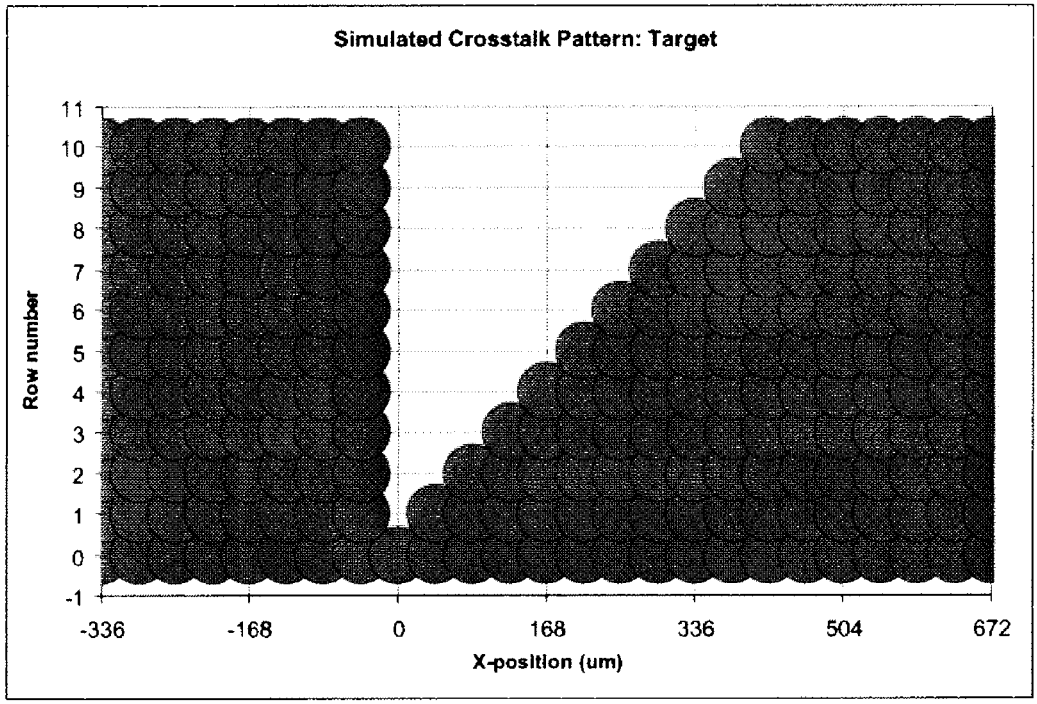
Figure 14B:
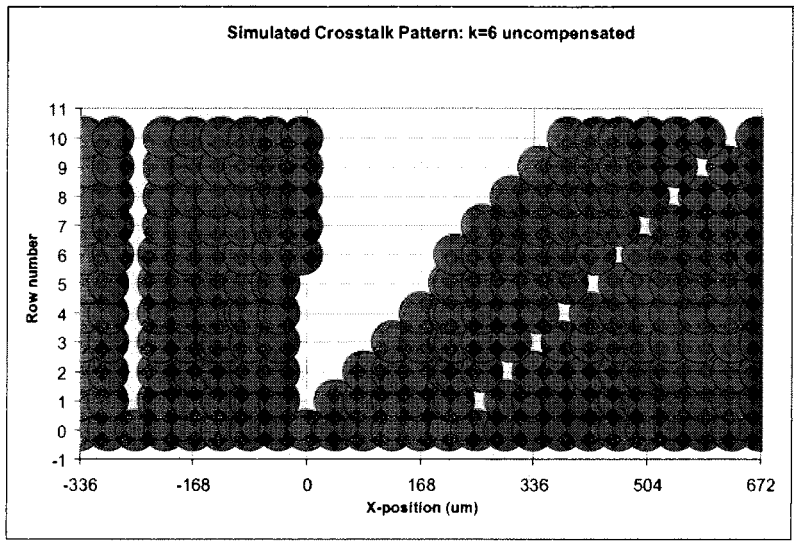
Figure 14B:
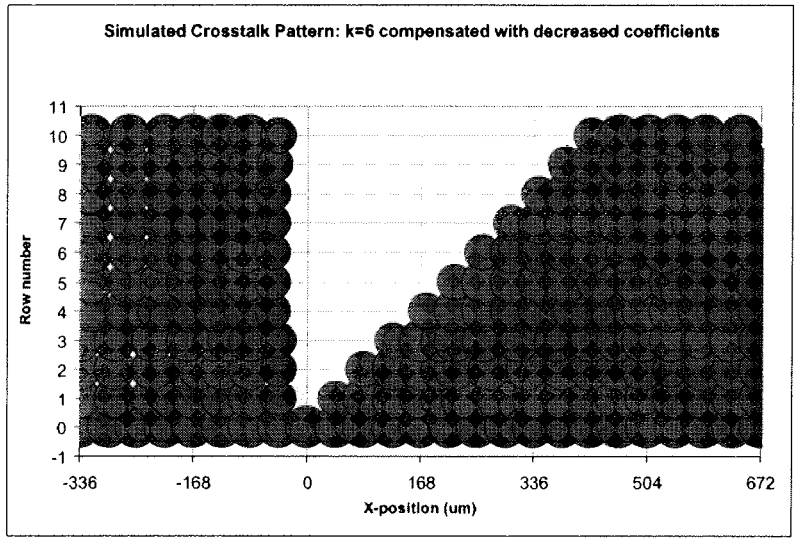
Figure 14B:
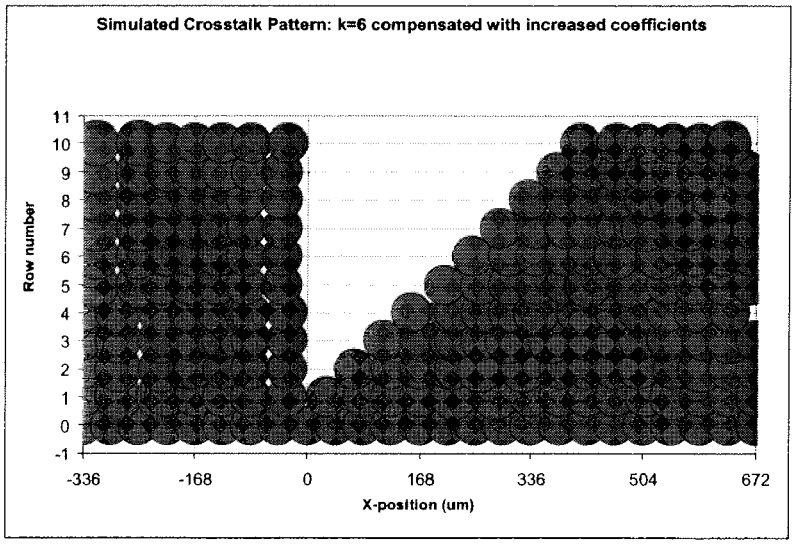
Figure 14C:
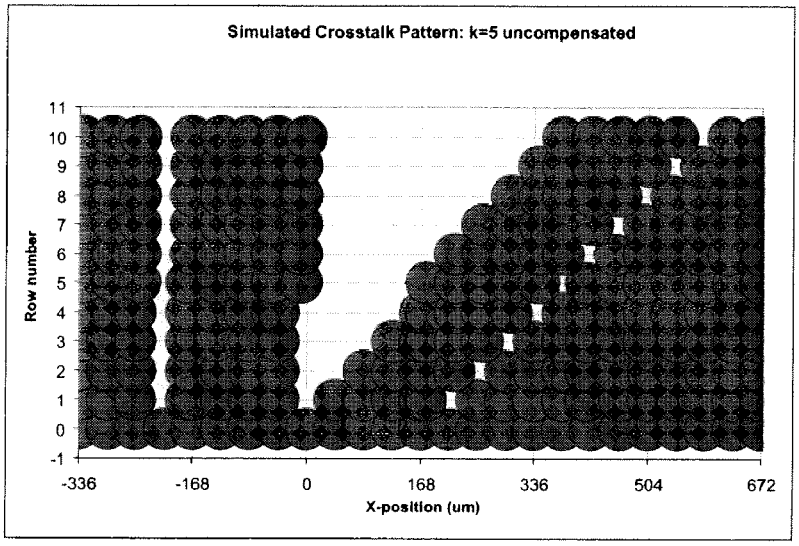
Figure 14C:
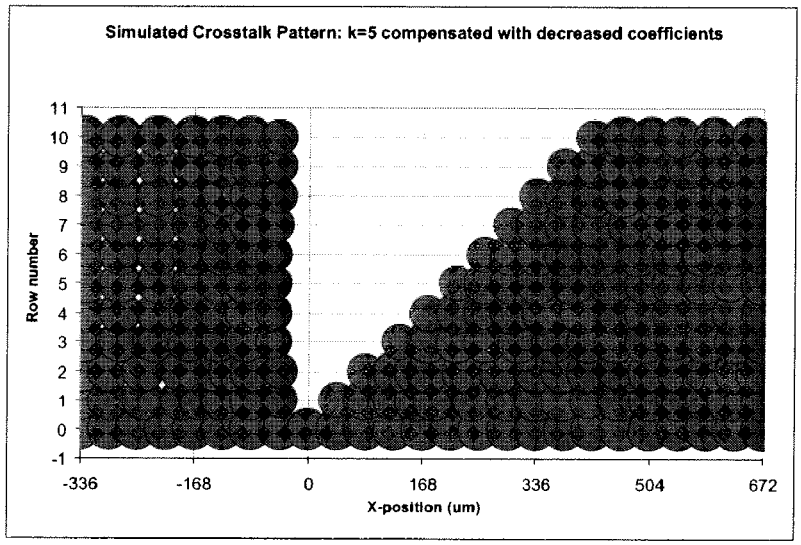
Figure 14C:
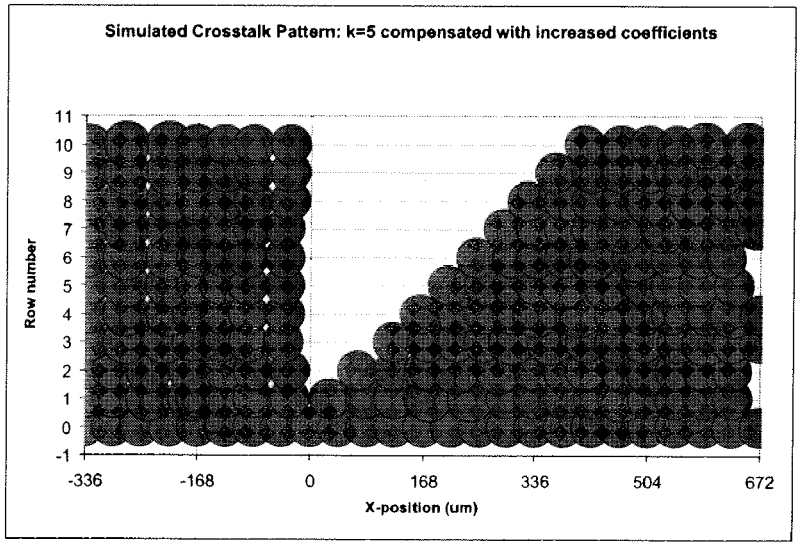
Figure 14D:
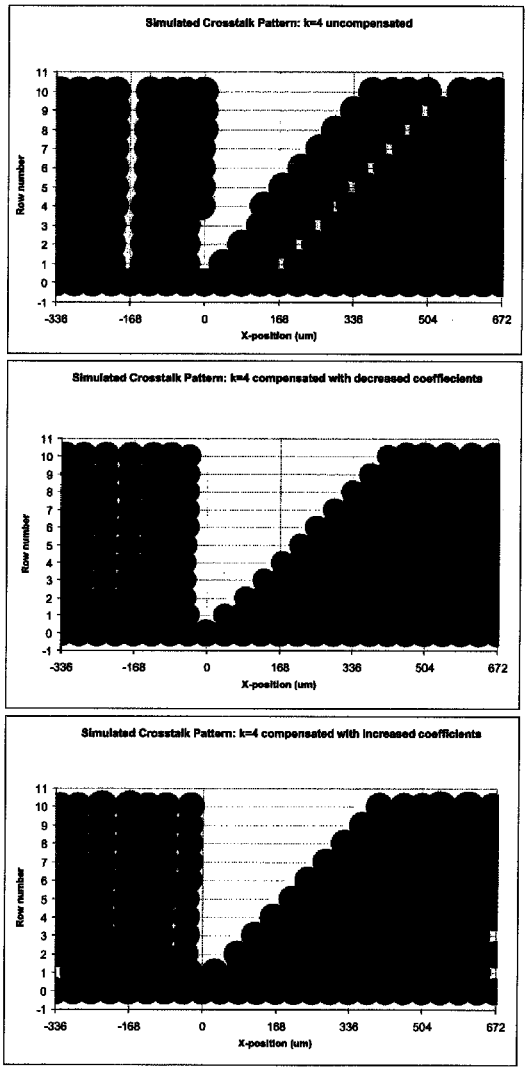
Figure 14E:
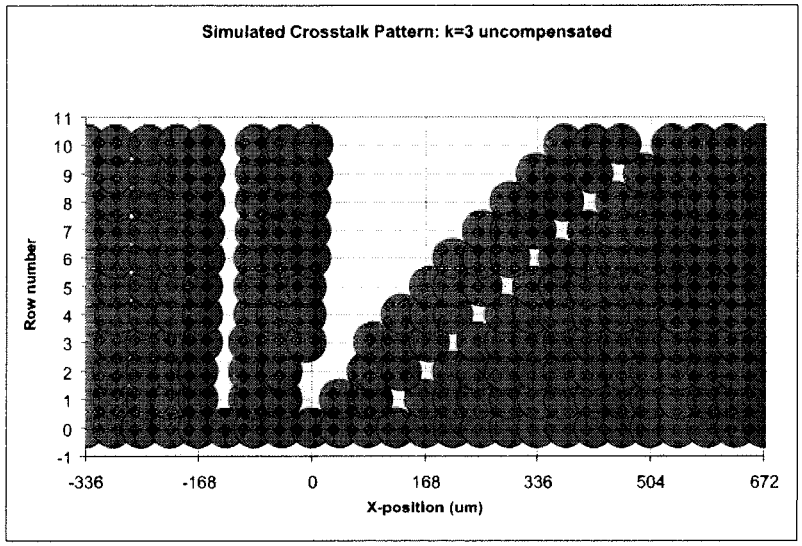
Figure 14E:
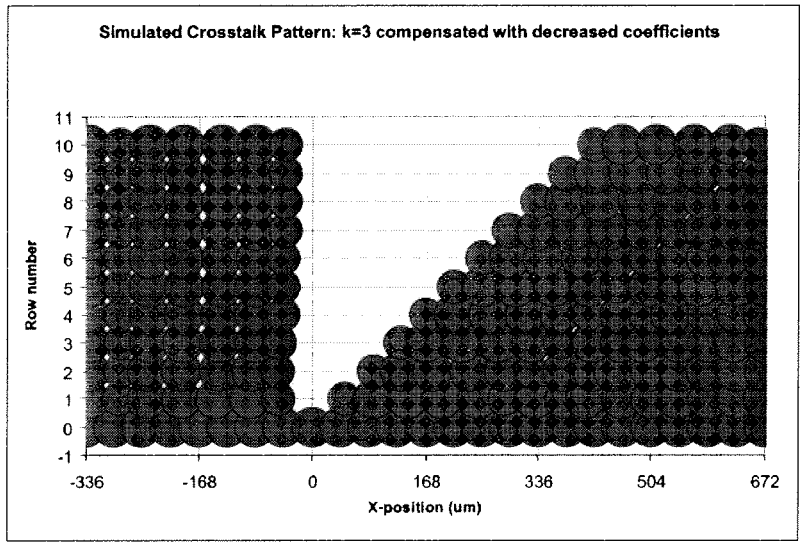
Figure 14E:
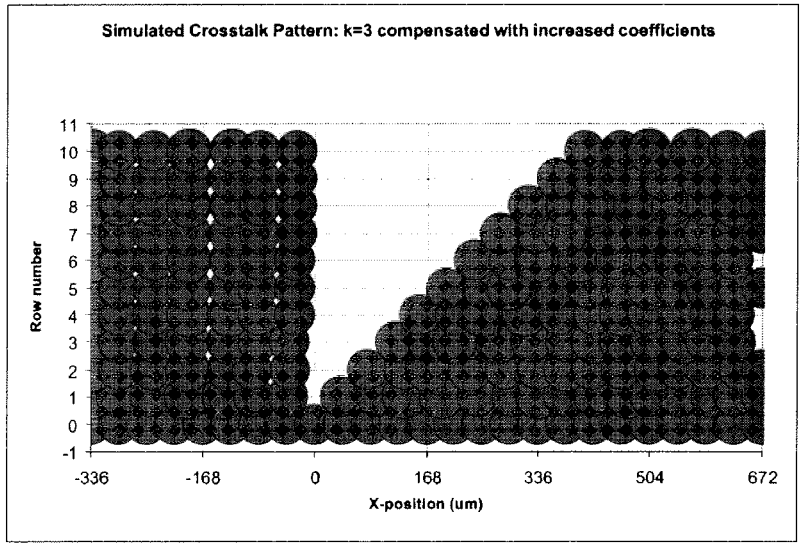
Figure 14F:
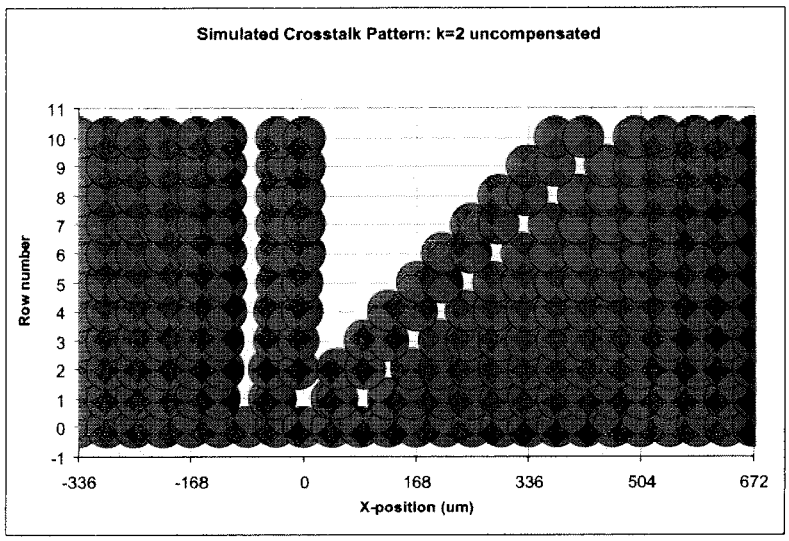
Figure 14F:
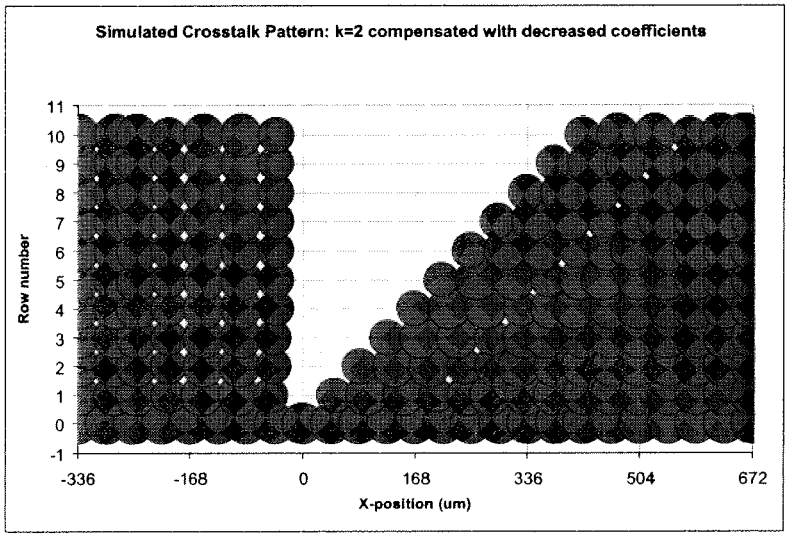
Figure 14F:
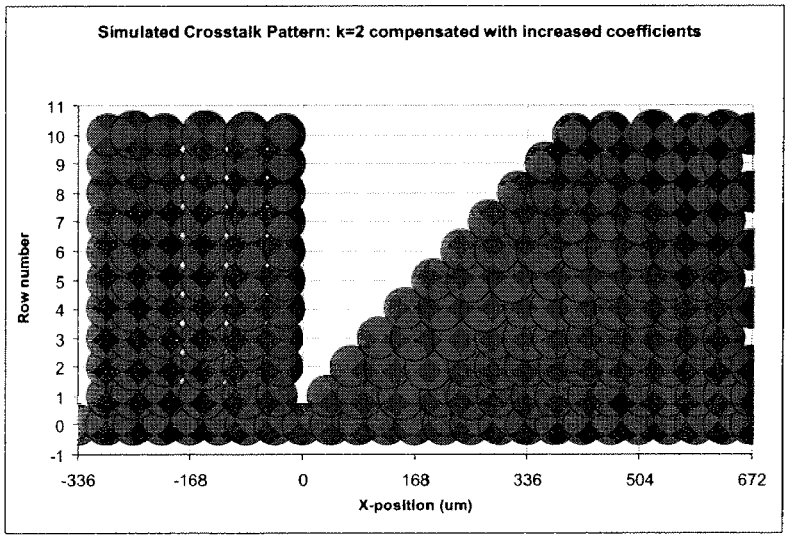
Figure 14G:
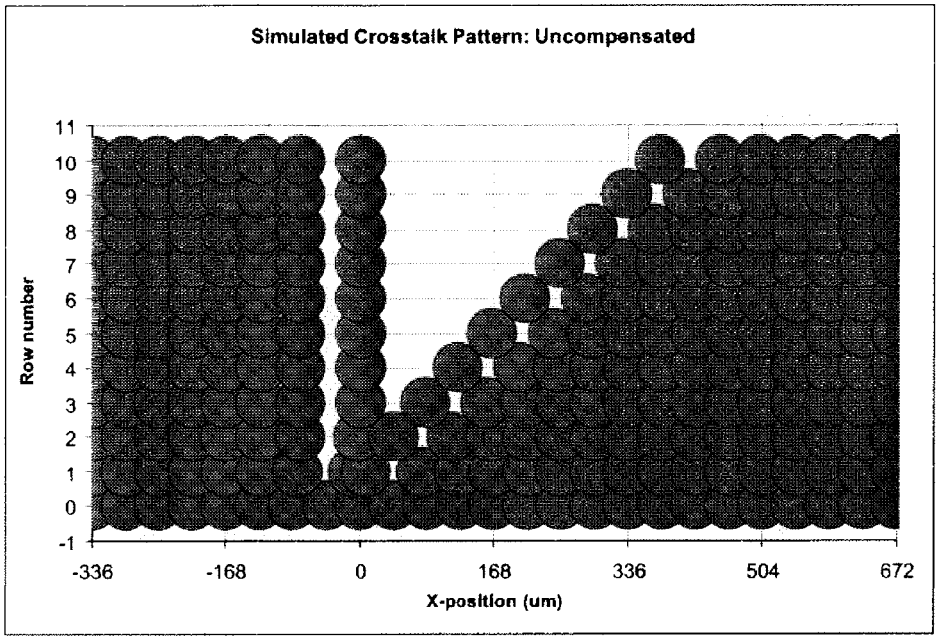
Figure 14G:
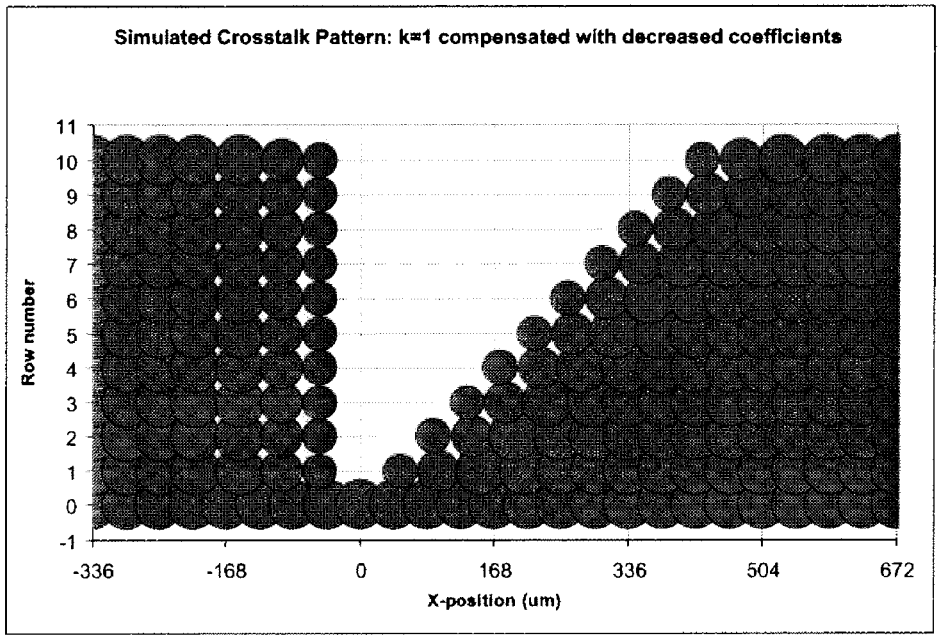

FIGS. 10*a* & 10*b* show simulated crosstalk patterns for 4-point negative "u" (a) with no compensation and (b) with compensation as described in this invention;

FIG. 11 illustrates four print simulations using other schemes of adjustment in comparison with target pixel positions, and the coefficient of compensation relating to different pixels;

FIG. 12 is a block diagram illustrating how the amplitude of an ejection pulse can be adjusted and a related waveform diagram showing resulting illustrative adjusted amplitudes of a pulse;

FIG. 13 is a block diagram illustrating how the duration of an ejection pulse can be adjusted and a related waveform diagram showing resulting illustrative adjusted durations of a pulse; and FIGS. 14A to 14G show, respectively, simulations of a target set of pixels in part of an image and of six different schemes of compensation, in each case in comparison with a simulation of an uncompensated print.

The crosstalk generated by any given image may be modelled by Equation 1, below.

$$\Delta x_e=(V_{e-1}-V_{e+1})X_1+(V_{e-2}-V_{e+2})X_2+(V_{e-3}-V_{e+3})X_3 \quad (1)$$

where:

$\Delta x_e$ is the x-deviation in dot position printed from ejector e of a row of ejectors (ejection locations) in a printhead $V_e$ is the normalised ejection strength of ejector e, between 0 and 1; this can be considered to be the equivalent of the greyscale image data for the pixel to be ejected $X_1$, $X_2$, $X_3$, are coefficients that determine the magnitude of crosstalk generated by the first, second and third neighbours of ejector e.

Figure 1:
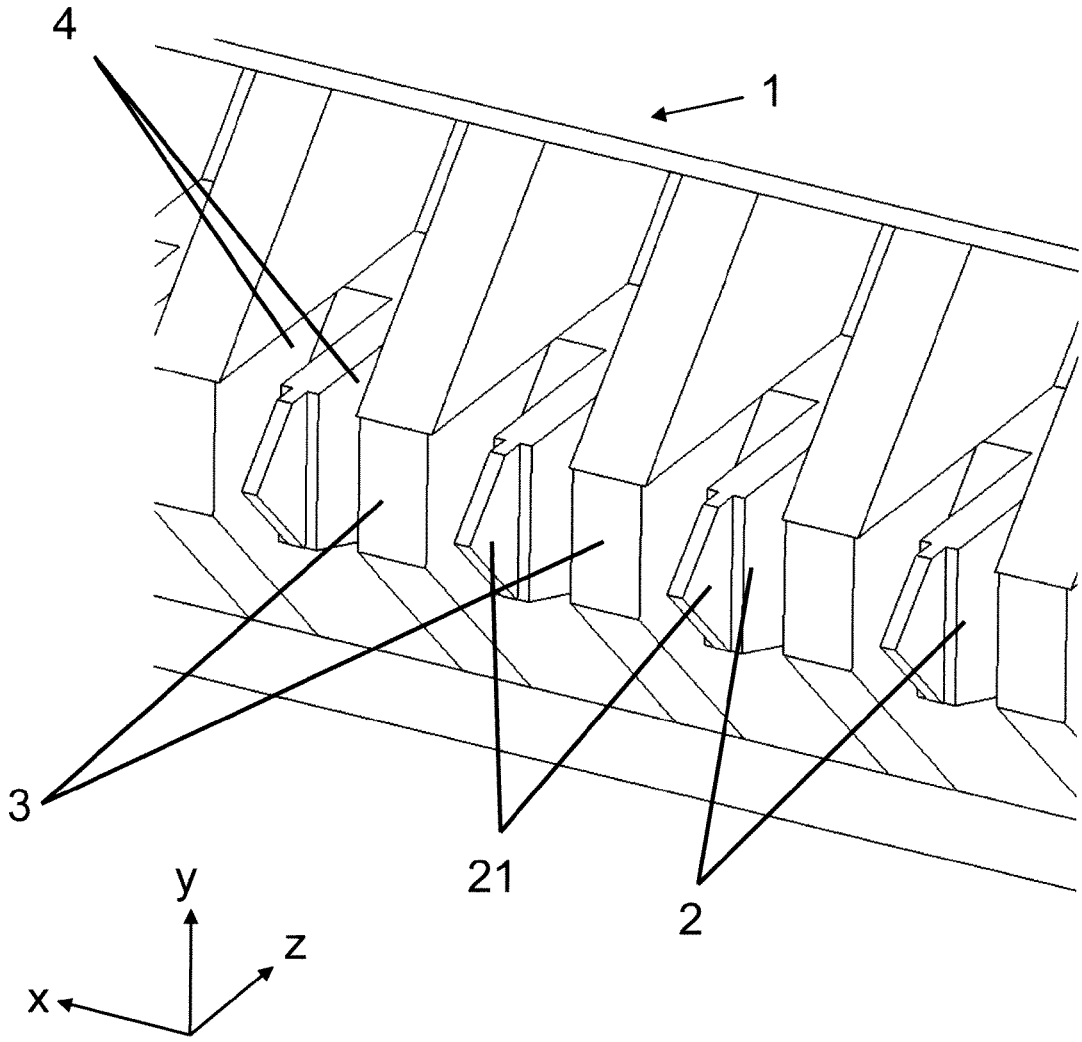
FIG. 1 is a CAD drawing showing detail of the ejection locations and ink feed channels for an electrostatic printer.
Figure 2:
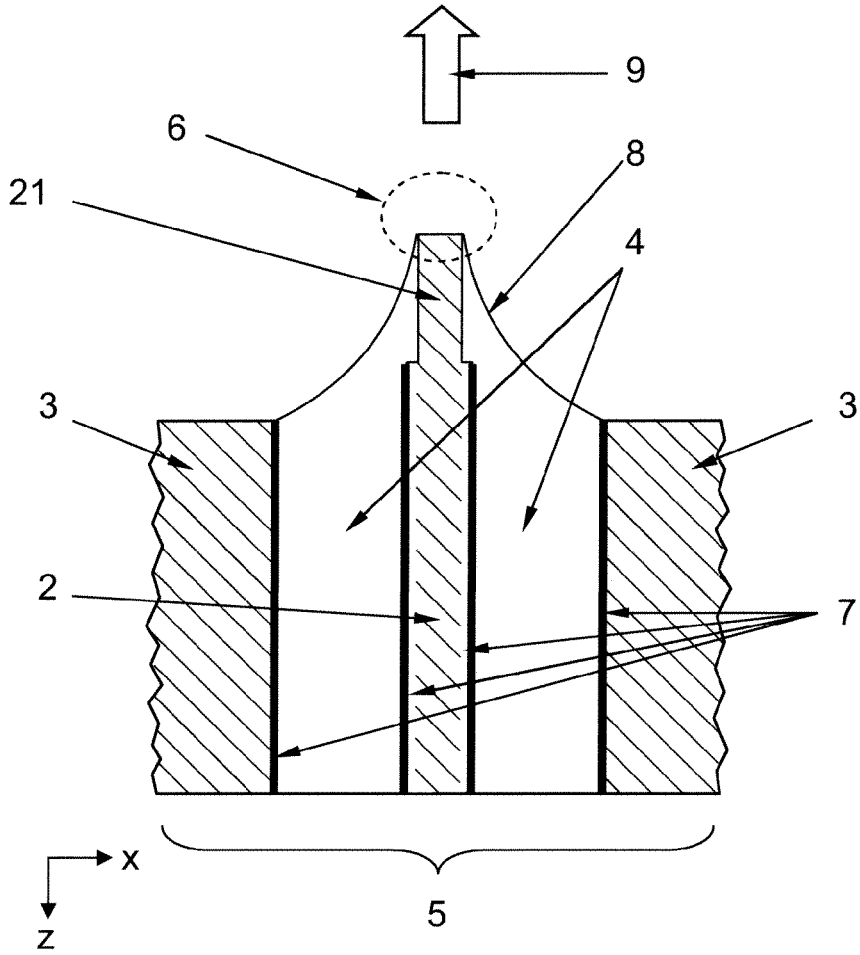
FIG. 2 is a schematic diagram in the x-z plane of the region around the ejection location in an electrostatic printhead of the type shown in FIG. 1.
Figure 3:
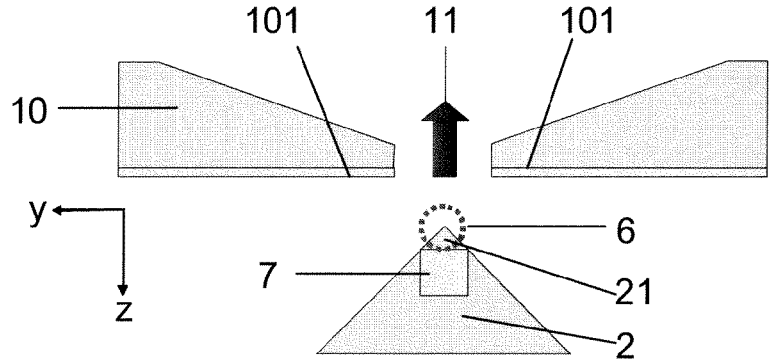
FIG. 3 is a schematic diagram in the y-z plane of the region around the ejection location in an electrostatic printhead of the type shown in FIG. 1.
Figure 4:
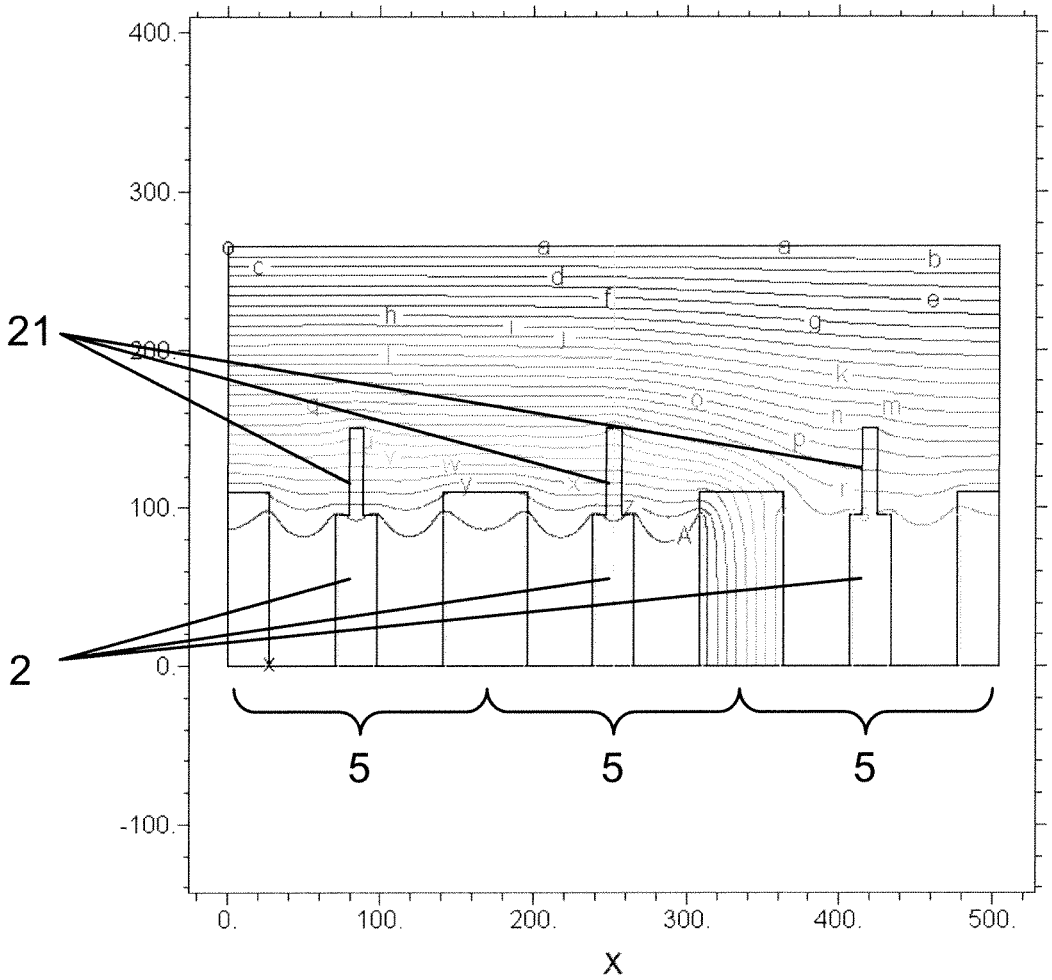
FIG. 4 is a diagram of numerical modelling of the equipotentials in the tip to IE region of an electrostatic printhead of the type shown in FIG. 1 in the x-z plane.
Figure 5:
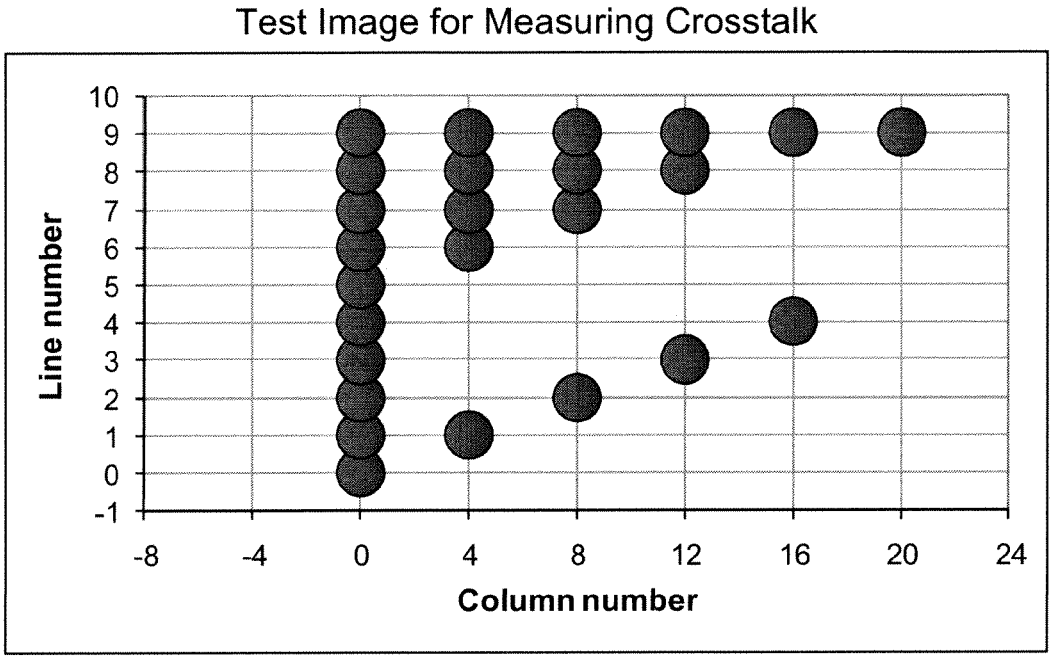
FIG. 5 shows a test image for measuring crosstalk.
Figure 6:
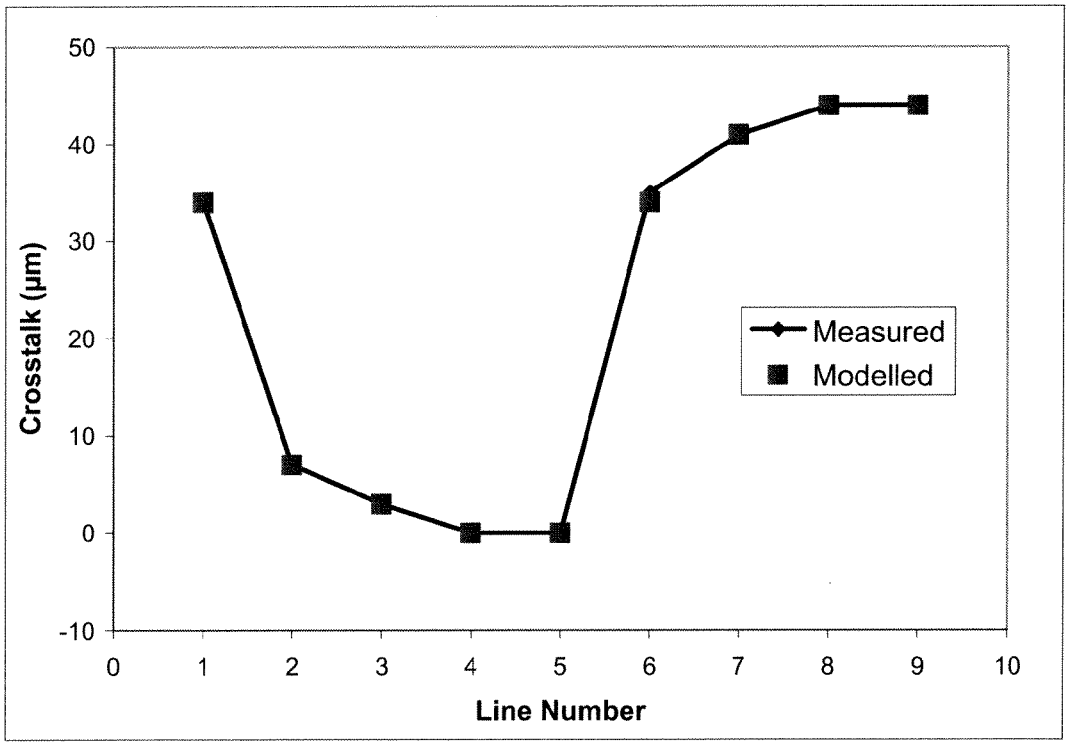
FIG. 6 shows a plot of measured and modelled crosstalk values for the test image shown in FIG. 5.

FIG. 5 shows a test image that, when printed, allows the values of $X_1$, $X_2$ and $X_3$ to be empirically determined. The different lines of the image generate a deflection of the dot (pixel) printed in column 0 that is a function of the precise ejection pattern of the neighbouring ejectors. FIG. 6 shows the deflection of the dot in column 0 as measured from an actual printed sample of the test image shown in FIG. 5, plotted as a function of the line of the test image. The coefficients $X_1$, $X_2$ and $X_3$ correspond to the magnitude of crosstalk from lines 1, 2 and 3 of FIG. 6, respectively; this corresponds to 34 μm, 7 μm and 3 μm, respectively.

Figure 7:
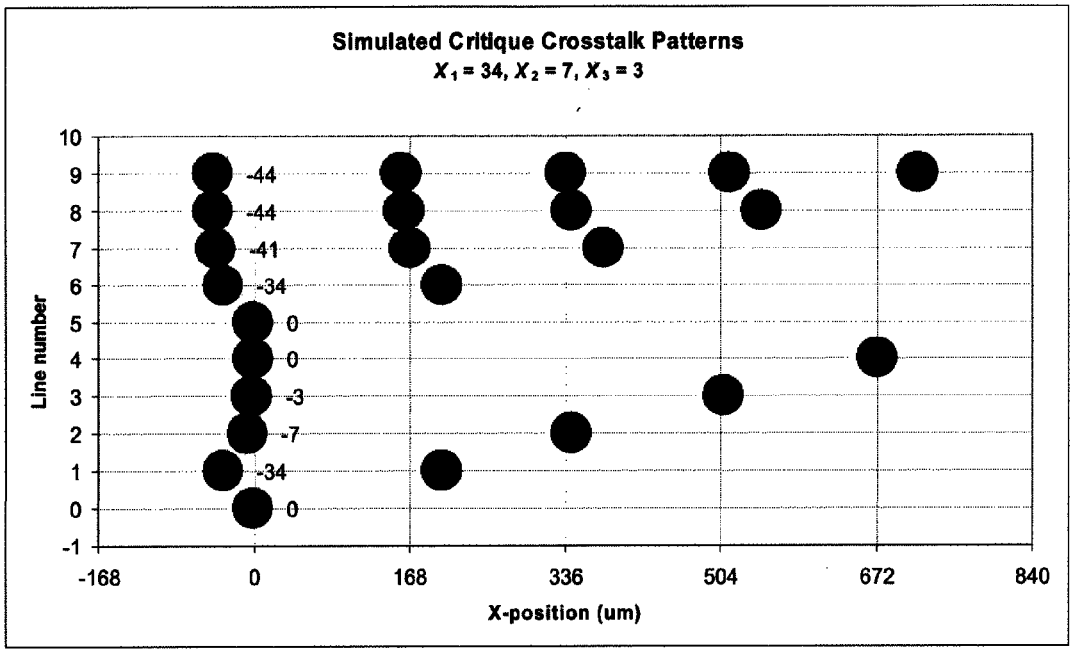
FIG. 7 shows a simulation of a printed version of FIG. 5, incorporating crosstalk.

The magnitude of crosstalk generated by lines 6-9 of FIG. 5 calculated using Equation 1 and the extracted values of $X_1$, $X_2$ and $X_3$ is a good match with the observed values shown in FIG. 6, confirming the validity of Equation 1. A simulation of the resulting printed version of FIG. 5 incorporating this level of crosstalk is shown in FIG. 7.

Figure 8:
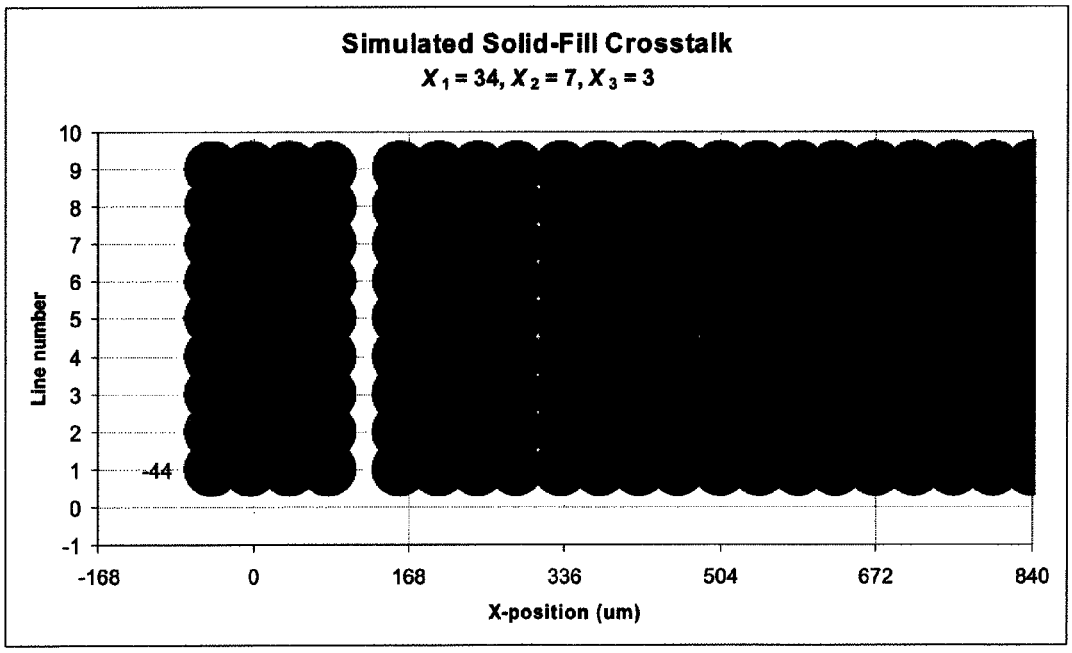
FIG. 8 shows simulated crosstalk effect at solid fill edge.

The consequence of this behaviour on the edge of a solid-fill region (i.e. all cells ejecting over a given region of the substrate) is shown in FIG. 8. It is common for images to be printed at a resolution higher than the native resolution of the ejectors in the printhead; this means that the printhead either has to make multiple passes over the substrate and is indexed in the direction of the row of ejection locations between each pass or else multiple printheads, offset transversely with respect to one another, are closely spaced one behind another to pass over the substrate simultaneously. FIG. 8 is a simulation of an image that has been printed at a resolution four times higher than the ejector density of the printhead. This simulation assumes that the image has been printed by indexing the printhead by one column three times to print four adjacent columns of dots (pixels). The same ejector therefore prints four adjacent dots each on one of four passes and the adjacent ejector prints the next block of four adjacent dots again one on each pass. Thus pixel columns 1 to 4 are printed from one ejection location on separate passes and pixel columns 5 to 8 are printed from the immediately adjacent ejection location, on separate passes, etc.

FIG. 8 incorporates simulated crosstalk by using Equation 1 and the experimentally derived parameters $X_1$, $X_2$ and $X_3$ to calculate the final positions of the dots or pixels on the substrate. This shows that the first four vertical lines of pixels are shifted left by 44 μm, the next four lines by 10 μm and the third four by 3 μm. A white line results if the shift is greater than the overlap between pixels. This is obvious between pixels four and five, visible between pixels eight and nine and just visible between pixels twelve and thirteen.

By modifying the ejection strength (ejection voltage pulse amplitude or duration) of some of the ejectors, it is possible to reduce the width of the widest white line situated between pixels four and five. Since pixel four is deflected primarily by the ejection for pixel eight, decreasing the ejection strength of pixel eight will reduce this deflection. Similarly, decreasing the strength of pixel one increases the deflection of pixel five, deflecting it to the left to further reduce the width of the white line.

Figure 9:
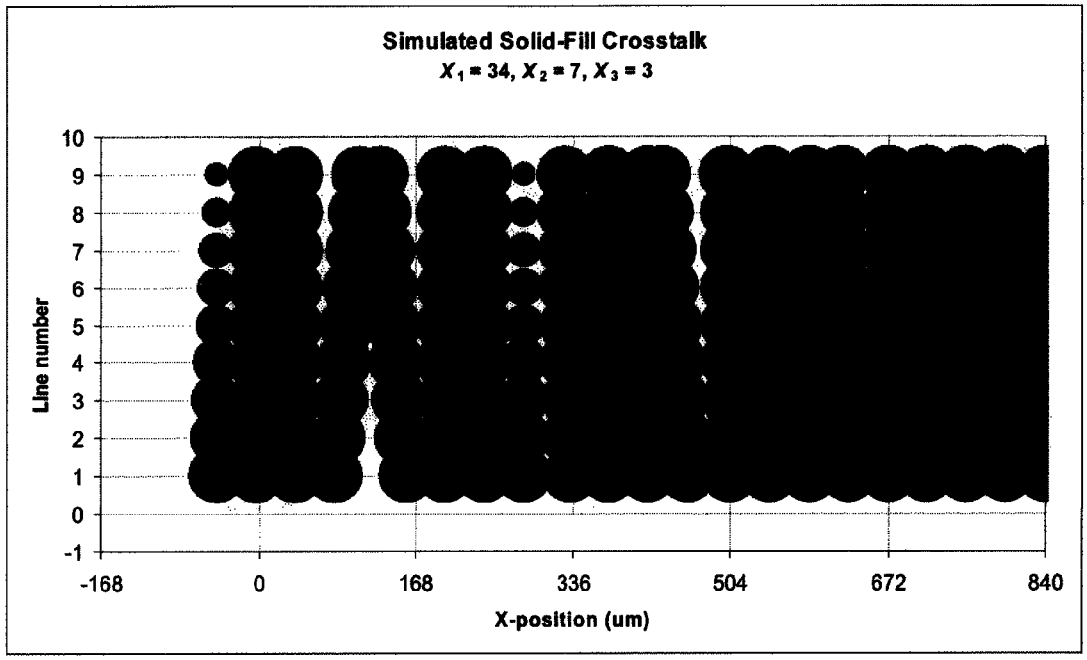
FIG. 9 shows a simulation of the effect on dot placement of printing with reduced strength for pixels 1 and 8 at the edge of a solid fill area.

FIG. 9 is a simulation of a solid-fill region, similar to FIG. 8. However, here, the ejection strengths of the pixels in column 1 and column 8 have been reduced by 10% for each increasing line number from 100% at line 1. This shows that the broad white line seen in FIG. 8 can be reduced with an optimum visual effect in the simulation for a value of between 0.6 and 0.7 of the initial or full ejection strength derived from the initial image. The result is a larger number of narrow spaces; however, these are less visible and are dispersed within the solid fill.

This method can be applied to more complex images, as shown in FIGS. 10A and 10B. FIG. 10A shows a simulated printed image of a negative lower-case 'u', incorporating crosstalk. The effect of this crosstalk is to turn the 'u' into a 'w' with other shadow effects. FIG. 10B shows a similar simulated printed image incorporating the compensation algorithm. The true shape of the letter 'u' is now revealed. In this case, the correction to the ejection strength of the chosen pixels looks best with a reduced ejection strength of 0.43. Experimentally, one usually chooses the correction to the ejection strength to achieve the best results, depending on the precise circumstances.

The correction to the ejection strengths may be described by a compensation coefficient for each of the chosen pixels, which acts as a linear multiplier to the bit value of those pixels. In the example above the compensation coefficient applied to the pixels of columns 1 and 8 is, therefore, 0.43. More generally, compensation schemes exist within the scope of the invention that can increase or decrease the values of chosen pixels by assigning coefficients that are correspondingly greater than one, or less than one, respectively.

FIG. 11 shows further simulations of crosstalk compensation schemes which may be used within the scope of the invention, similar to FIGS. 8 and 9, in comparison with a row of target pixel positions (shown at row zero on the left hand side of FIG. 11) and in comparison with four uncompensated rows of pixels (rows 2 to 5). Additionally, along side each of the sets (four rows deep) of simulated dot or pixel positions, there are shown the compensation coefficients allotted to each of the pixels in the four rows. It can be seen that the compensation in the top set of rows (rows 17 to 20) corresponds primarily to increased coefficients (i.e. increased amplitudes or durations of the ejecting voltage pulses), whereas the second set of rows (rows 12 to 15) involves both increased and reduced compensation coefficients, the third set of rows (rows 7 to 10) utilises just reduced coefficients, and the lower set of rows (rows 2 to 5) shows the effect when there is no compensation applied to the pixel values (coefficients of one). The lowest, single, row (row 0) shows the intended or target pixel position. Note that in addition to the compensation coefficients applied to the various pixels, pixel 0 in each of the rows 7 to 20 is left unprinted in accordance with algorithm 2 above. This removes the first pixel in each row before application of the primary algorithm, to ensure close matching of the 'edge' of the printed image to that of the desired 'target' image.

The method by which the ejection strength for individual pixels is modified involves the application of a purpose-written software filter to the bitmap image data. This filter, which can be incorporated into the design graphics software, e.g. Adobe Photoshop™, the raster image processing software, or used as a stand-alone application, identifies the pixels to be modified and adjusts their bit values according to the scheme described above. The voltage pulse produced by the print head drive electronics in response to these modified pixel values is correspondingly modified in amplitude or duration, depending on the type of drive electronics employed, as illustrated in FIGS. 12 & 13.

FIG. 12 shows the block diagram of a circuit 30 that can be used to control the amplitude of the ejection voltage pulses $V_E$ for each ejector (upstand 2 and tip 21) of the printhead, whereby the value $P_n$ of the bitmap pixel to be printed (an 8-bit number) is converted to a low-voltage amplitude by a digital-to-analogue converter 31, whose output is gated by a fixed-duration pulse $V_G$ that defines the duration of the high-voltage pulse $V_P$ to be applied to the ejector of the printhead. This low-voltage pulse is then amplified by a high-voltage linear amplifier 32 to yield the high-voltage pulse $V_P$, typically of amplitude 100 to 400V, dependent on the bit-value of the pixel, which in turn is superimposed on the bias voltages $V_B$ and $V_{IE}$ to provide the ejection pulse $V_E=V_{IE}+V_B+V_P$.

FIG. 13 shows the block diagram of an alternative circuit 40 that can be used to control the duration of the ejection voltage pulses $V_E$ for each ejector of the printhead, whereby the value $P_n$ of the bitmap pixel to be printed is loaded into a counter 41 by a transition of a "print sync" signal PS at the start of the pixel to be printed, setting the counter output high; successive cycles (of period T) of the clock input to the counter cause the count to decrement until the count reaches zero, causing the counter output to be reset low. The counter output is therefore a logic-level pulse $V_{PT}$ whose duration is proportional to the pixel value (the product of the pixel value $P_n$ and the clock period T); this pulse is then amplified by a high voltage switching circuit 42, which switches between a voltage $(V_{IE}+V_B)$ when low to $(V_{IE}+V_B+V_P)$ when high, thus generating the duration-controlled ejection pulse $V_E=V_{IE}+V_B+V_P$.

Of these alternative techniques, in practice it is simpler to modulate the duration of the pulse, but either technique may be appropriate in given circumstances and both may be used together.

FIGS. 14A to 14G show, respectively, simulations of a target set of pixels in part of an image having a wedge-shaped 'white' (i.e. unprinted) area and of six different schemes of compensation for different values of k (i.e. different numbers of printheads and passes of them to produce the printed image, and hence spacing offset), in each case in comparison with a simulation of an uncompensated print. It will be appreciated that in every compensated case, the regions of 'white space' apparent in the non-compensated simulated prints are reduced or removed altogether to provide an enhanced image.

This technique can be simply modified to reduce the effects of crosstalk in any image, regardless of the desired resolution of the image to be printed and the native resolution of the printhead. This technique can also be applied to ejectors at the end of an array printhead, where the absence of any further ejectors can also create crosstalk effects.

Use of the technique of the invention can be illustrated by taking FIG. 8 as an example. In this case a monochrome bitmap image to be printed consists of a two-dimensional array of pixels on a 42 by 42 micron pitch. The numerical value of each pixel defines its grey level, where zero corresponds to white and 1 corresponds to black. For this example, using the image of FIG. 8, the image consists of solid fill blocks (pixel value 1) with white space (pixel value 0) to the left. Whilst it will be appreciated that most images to be printed will be more complex than this in their arrangement of pixels, this simple image allows the compensation process to be illustrated clearly.

A horizontal line of this image has the following pixel values:

| $P_1$ | $P_2$ | $P_3$ | $P_4$ | $P_5$ | $P_6$ | $P_7$ | $P_8$ | $P_9$ | $P_{10}$ | $P_{11}$ | $P_{12}$ | $P_{13}$ | $P_{14}$ | $P_{15}$ | $P_{16}$ | $P_{17}$ | $P_{18}$ | $P_{19}$ | $P_{20}$ | $P_{21}$ | $P_{22}$ | $P_{23}$ | $P_{24}$ | $P_{25}$ | $P_{26}$ |
|---|---|---|---|---|---|---|---|---|---|---|---|---|---|---|---|---|---|---|---|---|---|---|---|---|---|
| 0 | 0 | 0 | 0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |

The image is printed using a print head that consists of a linear array of ejectors spaced on a 168 micron pitch. The print head is controlled to traverse the substrate to be printed four times in a direction perpendicular to the array, and during each pass the printhead is controlled to print a pattern of dots corresponding to every fourth pixel of the image along the direction of the array. Between each pass the printhead is indexed 42 microns along the axis of the array such that, over the four interleaved passes, the complete image is printed. The interleaving parameter, k, therefore takes the value 4. The size of each printed dot is controlled according to the corresponding pixel value, where zero corresponds to no dot and 1 corresponds to the maximum dot diameter of approximately 60 microns.

In accordance with the technique of the present invention, the errors created in the printed image may be compensated by decreasing the value of selected pixels, increasing the values of other selected pixels, or by a combination of the two. For the purposes of this example we will demonstrate compensation by reducing the values of the first printed pixel ($P_5$) and the eighth ($P_{12}$) from 1 to the value a as illustrated in FIGS. 9 and 11.

Using the experimentally determined values for the printhead of $X_1$=34 μm, $X_2$=7 μm and $X_3$=3 μm in Equation 1 gives an expression for the deviation from its ideal position in x of dots printed from ejector e of the printhead:

$$\Delta x_e=34(V_{e-1}-V_{e+1})+7(V_{e-2}-V_{e+2})+3(V_{e-3}-V_{e+3}) \qquad \text{Equation 2}$$

In terms of pixel number i and interleaving parameter k:

$$\Delta x_i=34(V_{i-k}-V_{i+k})+7(V_{i-2k}-V_{i+2k})+3(V_{i-3k}-V_{i+3k}) \qquad \text{Equation 3}$$

The pitch error between adjacent pixels i and (i+1) is $(\Delta x_{i+1}-\Delta x_i)$.

With reference to FIG. 9, the objective is to reduce the maximum pitch error between any two adjacent printing pixels to a minimum, thereby minimising the width of any erroneous white space between dots.

Table A below enumerates the effect of crosstalk, and the effect of compensation, from which the optimum value of the coefficient α is derived for this example.

TABLE A

| Pixel no. i (1) | Pixel value $P_i$ (2) | Position error $\Delta_{Xi}$ from Equation 1 (3) | Position error $\Delta_{Xi}$ from Equation 1 Value (μm) (4) | Pitch error $\Delta_{Xi+1}-\Delta_{Xi}$ (5) | Compensated pixel value (6) | Compensated pitch error (μm) $\Delta_{Xi+1}-\Delta_{Xi}$ As a function of α (7) | for α = 0.5 (8) | for α = 0.6 (9) | for α = 0.7 (10) | for α = 0.8 (11) |
|---|---|---|---|---|---|---|---|---|---|---|
| 1 | 0 | | | | 0 | | | | | |
| 2 | 0 | | | | 0 | | | | | |
| 3 | 0 | | | | 0 | | | | | |
| 4 | 0 | | | | 0 | | | | | |
| 5 | 1 | $-(X_1+X_2+X_3)$ | −44 | 0 | α | 0 | 0 | 0 | 0 | 0 |
| 6 | 1 | $-(X_1+X_2+X_3)$ | −44 | 0 | 1 | 0 | 0 | 0 | 0 | 0 |
| 7 | 1 | $-(X_1+X_2+X_3)$ | −44 | 0 | 1 | 34(1 − α) | 17 | 13.6 | 10.2 | 6.8 |
| 8 | 1 | $-(X_1+X_2+X_3)$ | −44 | 34 | 1 | 34(2α − 1) | 0 | 6.8 | 13.6 | 20.4 |
| 9 | 1 | $-(X_2+X_3)$ | −10 | 0 | 1 | 34(1 − α) | 17 | 13.6 | 10.2 | 6.8 |
| 10 | 1 | $-(X_2+X_3)$ | −10 | 0 | 1 | 0 | 0 | 0 | 0 | 0 |
| 11 | 1 | $-(X_2+X_3)$ | −10 | 0 | 1 | 0 | 0 | 0 | 0 | 0 |
| 12 | 1 | $-(X_2+X_3)$ | −10 | 7 | α | 7α | 3.5 | 4.2 | 4.9 | 5.6 |
| 13 | 1 | $-X_3$ | −3 | 0 | 1 | 7(1 − α) | 3.5 | 2.8 | 2.1 | 1.4 |
| 14 | 1 | $-X_3$ | −3 | 0 | 1 | 0 | 0 | 0 | 0 | 0 |
| 15 | 1 | $-X_3$ | −3 | 0 | 1 | −34(1 − α) | −17 | −13.6 | −10.2 | −6.8 |
| 16 | 1 | $-X_3$ | −3 | 3 | 1 | 34(1 − α) + 3α | 18.5 | 15.4 | 12.3 | 9.2 |
| 17 | 1 | 0 | 0 | 0 | 1 | 3(1 − α) | 1.5 | 1.2 | 0.9 | 0.6 |
| 18 | 1 | 0 | 0 | 0 | 1 | 0 | 0 | 0 | 0 | 0 |
| 19 | 1 | 0 | 0 | 0 | 1 | −7(1 − α) | −3.5 | −2.8 | −2.1 | −1.4 |
| 20 | 1 | 0 | 0 | 0 | 1 | 7(1 − α) | 3.5 | 2.8 | 2.1 | 1.4 |
| 21 | 1 | 0 | 0 | 0 | 1 | 0 | 0 | 0 | 0 | 0 |
| 22 | 1 | 0 | 0 | 0 | 1 | 0 | 0 | 0 | 0 | 0 |
| 23 | 1 | 0 | 0 | 0 | 1 | −3(1 − α) | −1.5 | −1.2 | −0.9 | −0.6 |
| 24 | 1 | 0 | 0 | 0 | 1 | 3(1 − α) | 1.5 | 1.2 | 0.9 | 0.6 |
| 25 | 1 | 0 | 0 | 0 | 1 | 0 | 0 | 0 | 0 | 0 |
| 26 | 1 | 0 | 0 | 0 | 1 | Maximum | 18.5 | 15.4 | 13.6 | 20.4 |

In Table A, the uncompensated pitch errors are shown in column 5 and the expressions for the compensated pitch errors in terms of the coefficient α as derived from Equation 3 are shown in column 7. Columns 8 to 11 show the resulting values of pitch error for values of α=0.5, 0.6, 0.7 and 0.8, showing that α=0.7 provides the lowest maximum pitch error of these values. In fact the maximum pitch error is minimised in this example when $34(2\alpha-1)=34(1-a)+3\alpha$, giving $\alpha=0.687$ or, in terms of the coefficients $X_1$, $X_2$, $X_3$: $\alpha=2X_1/(3X_1-X_3)$, but in practice it is sufficient to round a to one decimal place.

The optimum value of $\alpha$ in this example can be seen from line 4 in FIG. 9 and is 0.7 and can be established for a given printer and print process.

Compensation is applied to the image data according to the algorithm of the invention, which examines the bitmap image for transitions from light ($P_i \le P_L$) to dark ($P_i \ge P_H$) in the direction across the printhead, the width of the dark area that is searched for being at least (k+1) pixels. Hence, for this example (having k=4), the algorithm searches for one or more contiguous light pixels adjacent five or more contiguous dark pixels, then multiplies the edge pixel by the coefficient $\alpha_1$ and the eighth ($2k^{th}$) pixel from the edge by $\alpha_8$.

Table B shows the step-by-step process defined by the algorithm of the invention for this example.

TABLE B

| i | $P_i$ | $P_i \le P_L$? | $P_{i+1} \ldots P_{i+5} \ge P_H$? | $P_{i-1} \ldots P_{i-5} \ge P_H$? | j | αj | $P_{i+j}$ |
|---|---|---|---|---|---|---|---|
| 1 | 0 | Y | N | N | | | |
| 2 | 0 | Y | N | N | | | |
| 3 | 0 | Y | N | N | | | |
| 4 | 0 | Y | Y | N | 1 | 0.7 | $P_5$: = 0.7 |
| | | | | | 2 | 1 | |
| | | | | | 3 | 1 | |
| | | | | | 4 | 1 | |
| | | | | | 5 | 1 | |
| | | | | | 6 | 1 | |
| | | | | | 7 | 1 | |
| | | | | | 8 | 0.7 | $P_{12}$: = 0.7 |
| | | | | | 9 . . . 17 | 1 | |
| 5 | 1 | N | Y | N | | | |
| 6 | 1 | N | Y | N | | | |
| 7 | 1 | N | Y | N | | | |
| 8 | 1 | N | Y | N | | | |
| 9 | 1 | N | Y | N | | | |
| 10 | 1 | N | Y | Y | | | |
| 11 . . . 26 | 1 | N | Y | Y | | | |

Hence, in the pattern of FIG. 9, line number 4 is created with a reduction in maximum pitch error (between the fourth and fifth printing pixels) from 34 μm to 13.6 μm.

The invention claimed is:

1. A method of preparing a two-dimensional bit-mapped image having n pixels per row for printing using one or more printheads each having a row of ejection locations, each ejection location having associated ejection electrodes to which a voltage is applied in use sufficient to cause particulate agglomerations to be formed from within a body of printing fluid, and wherein, in order to cause charged particulate agglomerations to be ejected as printed droplets from selected ejection locations, voltage pulses of predetermined amplitude and duration, as determined by the respective bit values $P_i$, where $1 \le i \le n$, of the individual pixels of rows of the image, are applied to the electrodes of the selected ejection locations, wherein $P_i$ is determined by the expression:

FOR i=1 to n:

FOR j=1 to (4k+1):

IF $P_i \le P_L$ AND $P_{i+1} \ldots P_{i+(1+k)} \ge P_H$ then $P_{i+j} := \alpha_j \cdot P_{i+j}$ or IF $P_i \le P_L$ AND $P_{i-1} \ldots P_{1-(1+k)} \ge P_H$ then $P_{i-j} := \alpha_j \cdot P_{i-j}$ where $\alpha_j < 1$ for j=1 or j=2k and $\alpha_j \le 1$ for j=3k or j=4k

OR

FOR i=1 to n:

FOR j=1 to (4k+1):

IF $P_i \le P_L$ AND $P_{i+1} \ldots P_{i+(1+k)} \ge P_H$ then $P_{i+j} := \alpha_j \cdot P_{i+j}$ or IF $P_i \le P_L$ AND $P_{i-1} \ldots P_{i-(1+k)} \ge P_H$ then $P_{i-j} := \alpha_j \cdot P_{i-j}$ where $\alpha_j > 1$ for $k \ge 2$ and (j=k or k+1), and $\alpha_j \ge 1$ for $k \ge 3$ and ($2 \le j \le k-1$ or $k+2 \le j \le 2k-1$ or j=2k+1, 3k+1, or 4k+1), where $P_L$ is a low threshold and $P_H$ is a high threshold defined as $0 < P_L < P_H < 1$, and where the arrangement of the printheads forms an array of ejector locations on a spacing parallel to the rows of the image of k times the pixel spacing of the image arranged parallel to the width of the image, with A interleaved printheads arranged to print on B interleaved passes, such that k=A.B such that a given printhead on a given pass will print the pixels of every kth column of the image.

2. A method according to claim 1, wherein the values of $P_{i+1}$ or $P_{i-1}$ are additionally adjusted in a preliminary step in accordance with the following algorithm:

FOR $i = 1$ to $n$:

$$\text{IF} \left\{ \begin{array}{ll} P_i \le P_L & 1 \le k \le 3 \\ P_i \ \ldots \ P_{i-(k-3)} \le P_L & k \ge 4 \end{array} \right\}$$

AND $P_{i+1} \ \ldots \ P_{i+(1+k)} \ge P_H$ then $P_{i+1} := P_i$

OR $$\text{IF} \left\{ \begin{array}{ll} P_i \le P_L & 1 \le k \le 3 \\ P_i \ \ldots \ P_{i+(k-3)} \le P_L & k \ge 4 \end{array} \right\}$$

AND $P_{i+1} \ \ldots \ P_{i-(1+k)} \ge P_H$ then $P_{i-1} := P_i$.

3. A method of printing a bit-mapped image using a printhead having a row of ejection locations, each ejection location having associated ejection electrodes to which a voltage is applied in use sufficient to cause particulate agglomerations to be formed from within a body of printing fluid, and wherein, in order to cause charged droplet agglomerations to be ejected as printed droplets from selected ejection locations, voltage pulses of predetermined amplitude and duration, as determined by the bit values of the individual pixels of the image, are applied to the electrodes of the selected ejection locations, wherein the bit-mapped image has printed pixels such as to require simultaneous ejection from two adjacent ejection locations, on one side of which ejection locations there is no simultaneously printing ejection location, the method including preparing the bit-mapped image according to claim 2.

4. A method of printing a bit-mapped image using a printhead having a row of ejection locations, each ejection location having associated ejection electrodes to which a voltage is applied in use sufficient to cause particulate agglomerations to be formed from within a body of printing fluid, and wherein, in order to cause charged droplet agglomerations to be ejected as printed droplets from selected ejection locations, voltage pulses of predetermined amplitude and duration, as determined by the bit values of the individual pixels of the image, are applied to the electrodes of the selected ejection locations, wherein the bit-mapped image has printed pixels such as to require simultaneous ejection from two adjacent ejection locations, on one side of which ejection locations there is no simultaneously printing ejection location, the method including preparing the bit-mapped image according to claim 1.

* * * * *